US008287106B2

(12) United States Patent
Yokouchi et al.

(10) Patent No.: US 8,287,106 B2
(45) Date of Patent: Oct. 16, 2012

(54) LIQUID EJECTING APPARATUS

(75) Inventors: Hideya Yokouchi, Okaya (JP); Mitsutaka Iwasaki, Kodaira (JP)

(73) Assignee: Seiko Epson Corporation, Tokyo (JP)

( * ) Notice: Subject to any disclaimer, the term of this patent is extended or adjusted under 35 U.S.C. 154(b) by 552 days.

(21) Appl. No.: 12/139,272

(22) Filed: Jun. 13, 2008

(65) Prior Publication Data

US 2008/0309706 A1 Dec. 18, 2008

(30) Foreign Application Priority Data

Jun. 15, 2007 (JP) ..... 2007-158618
Apr. 23, 2008 (JP) ..... 2008-112082

(51) Int. Cl.
*B41J 2/175* (2006.01)

(52) U.S. Cl. ..... 347/85

(58) Field of Classification Search ..... None
See application file for complete search history.

(56) References Cited

U.S. PATENT DOCUMENTS 4,502,055 A * 2/1985 Horike et al. ..... 347/92
6,824,261 B2 * 11/2004 Watari et al. ..... 347/97
2007/0222843 A1 * 9/2007 Uchiyama et al. ..... 347/92

FOREIGN PATENT DOCUMENTS

JP 2000-025245 1/2000
JP 2005-219229 8/2005
JP 2006-075683 3/2006
JP 2006-095878 4/2006
JP 2006-150626 6/2006
JP 2006-224312 8/2006
JP 2006-327097 12/2006
JP 2007-062173 3/2007

OTHER PUBLICATIONS

Translations of JP 2007-062173 and JP 2006-095878 were used, references dated 2007 and 2006 respectively.*

* cited by examiner

*Primary Examiner* — Matthew Luu
*Assistant Examiner* — Alejandro Valencia
(74) *Attorney, Agent, or Firm* — Workman Nydegger

(57) ABSTRACT

A liquid ejecting apparatus for ejecting liquid from an ejection head, the liquid being supplied from a liquid supplying source, the liquid ejecting apparatus comprising: a carriage having the ejection head including: a liquid channel configured for flowing the liquid from the liquid supplying source to the ejection head; a gas trap chamber which is formed in the midstream of the liquid channel and expands the width of the liquid channel; and a gas recovery chamber which is adjacent to the gas trap chamber and having a gas permeable wall between the gas recovery chamber and the gas trap chamber; a carriage driver which drives the carriage; an attachment/detachment connection which is detachably connected to the gas recovery chamber; and a depressurization unit which decreases a pressure of the gas recovery chamber to a pressure lower than that of the gas trap chamber via the attachment/detachment connection.

15 Claims, 16 Drawing Sheets

LIQUID EJECTING APPARATUS

CROSS-REFERENCE TO RELATED APPLICATIONS

This application claims the benefit of Japanese Patent Application No. 2007-158618, filed Jun. 15, 2007 and Japanese Patent Application No. 2008-112082, filed Apr. 23, 2008, both of which are expressly incorporated herein by reference in their entirety.

BACKGROUND

1. Technical Field

The present invention relates to a liquid ejecting apparatus for ejecting liquid supplied from a liquid supplying source from an ejection head.

2. Related Art

One example of a liquid ejecting apparatus currently known in the art is an ink jet printer which ejects ink droplets and recording characters or drawings onto a thin-plate recording medium such as paper or plastic. In addition, another example liquid ejecting apparatus ejects various liquid-type materials which form color materials or electrodes onto a pixel forming area or an electrode forming area, in a display manufacturing apparatus. The display manufacturing apparatus is used for manufacturing a liquid crystal display, a plasma display, an organic electroluminescence (EL) display, a field emission display (FED) or the like.

In a typical liquid ejecting apparatus, a liquid channel for guiding the liquid from the liquid supplying source, in which the liquid is stored, to the ejection head is formed by a resin tube or a frame wall as described in Japanese Patent Application JP-A-2005-219229. However, in such a liquid ejecting apparatus, it is difficult to prevent the air outside the liquid channel from passing through the tube or the frame wall and passing through the liquid channel. Any of this air that is not completely melted in the liquid may cause one or more air bubbles to occur in the liquid in the liquid channel. The air bubbles which occur in the liquid channel are gradually grown and absorb pressure which is applied to the liquid in order to eject the liquid. This often leads to a failure in ejection of the liquid or a failure in the supply of the liquid due to the clogging of the liquid channel.

In order to prevent the air bubbles from being mixed with the liquid, one solution provides for a chamber in a common liquid chamber that is in communication with a pressure chamber which applies ejection pressure to the liquid with an air-permeable film interposed therebetween. This decreases the pressure of the chamber so as to be lower than that of the common liquid chamber, which in turn suppresses the occurrence of the air bubbles in the pressure chamber. This is described in Japanese Patent Application JP-A-2006-95878.

However, various configurations for efficiently eliminating the air bubbles mixed into the liquid in the liquid channel (for example, the structure of the liquid chamber or the chamber and the configuration of the depressurizing unit for depressurizing the pressure of the chamber) are not sufficiently considered.

BRIEF SUMMARY

An advantage of some aspects of the invention is that it provides a liquid ejecting apparatus capable of efficiently eliminating air bubbles mixed into liquid in a liquid channel. The invention also advantageously provides for a less complex apparatus.

According to a first embodiment of the invention, a liquid ejecting apparatus for ejecting liquid from an ejection head, the liquid being supplied from a liquid supplying source, is provided. The liquid ejecting apparatus comprises: a carriage having the ejection head, the carriage including: a liquid channel configured for flowing the liquid from the liquid supplying source to the ejection head, a gas trap chamber which is formed in the midstream of the liquid channel and expands the width of the liquid channel, and a gas recovery chamber which is adjacent to the gas trap chamber with a gas permeable wall; a carriage driver which drives the carriage; an attachment/detachment connection which is detachably connected to the gas recovery chamber according to the position of the carriage; and a depressurization unit which decreases the pressure of the gas recovery chamber to a pressure lower than that of the gas trap chamber via the attachment/detachment connection.

According to this embodiment of the liquid ejecting apparatus, since the gas trap chamber and the gas recovery chamber are efficiently provided relative to the liquid channel and the gas recovery chamber is detachably connected to the depressurization unit, it is possible to efficiently eliminate air bubbles mixed into the liquid in the liquid channel while also suppressing the enlargement of the carriage and the complexity of the structure.

In other embodiments, the liquid ejecting apparatus may further comprise a hermetically sealing valve which is provided in the gas recovery chamber of the carriage and hermetically seals the gas recovery chamber while the attachment/detachment connection is separated from the gas recovery chamber. According to this embodiment of the liquid ejecting apparatus, since the pressure of the gas recovery chamber is maintained in a state of being decreased while the attachment/detachment connection is separated from the gas recovery chamber, it is possible to eliminate the air bubbles mixed into the liquid in the liquid channel even when the power is not turned off.

A further embodiment of the liquid ejecting apparatus may further comprise a head cleaner which is detachably connected to the ejection head. The head cleaner forms a liquid suction chamber with the ejection head according to the position of the carriage when the carriage is driven and moved by the carriage driver. The depressurization unit decreases the pressure of the gas recovery chamber to a pressure that is lower than that of the gas trap chamber via the attachment/detachment connection when the attachment/detachment connection is connected to the gas recovery chamber and decreases the pressure of the liquid suction chamber to a pressure that is lower than that of the liquid channel via the head cleaner when the head cleaner is connected to the ejection head. According to this embodiment of the liquid ejecting apparatus, since the depressurization unit for depressurizing the gas recovery chamber can be used for depressurizing the liquid suction chamber, it is possible to simplify the configuration of the liquid ejecting apparatus.

In some embodiments of the liquid ejecting apparatus, the depressurization unit may include a first opening prevention unit which prevents negative pressure from being opened from the head cleaner while the attachment/detachment connection is connected to the gas recovery chamber. According to this embodiment of the liquid ejecting apparatus, since the negative pressure is prevented from being opened from the head cleaner while the attachment/detachment connection is connected to the gas recovery chamber, it is possible to efficiently depressurize the gas recovery chamber.

In further embodiments of the liquid ejecting apparatus, the depressurization unit may include a second opening prevention unit which prevents negative pressure from being opened from the attachment/detachment connection while the head cleaner is connected to the ejection head. According to this embodiment of the liquid ejecting apparatus, since the negative pressure is prevented from being opened from the attachment/detachment connection while the head cleaner is connected to the ejection head, it is possible to efficiently depressurize the liquid suction chamber.

In further embodiments of the liquid ejecting apparatus, when the carriage is in a position in which the head cleaner is connected to the ejection head, the attachment/detachment connection may be connected to the gas recovery chamber. According to this embodiment of the liquid ejecting apparatus, since the depressurization of the liquid suction chamber and the depressurization of the gas recovery chamber are simultaneously performed, it is possible to decrease the time necessary for the maintenance of the liquid ejecting apparatus.

The liquid ejecting apparatus, in an additional embodiment, may further include a pressure regulating valve which is provided in the midstream of the liquid channel of the carriage and regulates the pressure of the liquid flowing in the liquid channel. In such embodiment, the gas trap chamber includes at least one of an upstream trap chamber which is formed at an upstream side of the pressure regulating valve in the liquid channel, and a downstream trap chamber which is formed at a downstream side of the pressure regulating valve in the liquid channel. According to this embodiment of the liquid ejecting apparatus, any air bubbles which are generated by accessing the pressure regulating valve can be eliminated in the upstream trap chamber and any air bubbles generated by the action of the pressure regulating valve can be eliminated in the downstream trap chamber.

Another embodiment of the liquid ejecting apparatus may further include a first determination unit which determines whether depressurization of the gas recovery chamber is performed by the depressurization unit, according to power applied to the liquid ejecting apparatus. According to this embodiment of the liquid ejecting apparatus, the depressurization of the gas recovery chamber can be accurately performed so as to cope with a situation in which a next depressurization process of the gas recovery chamber cannot be estimated.

Another embodiment of the liquid ejecting apparatus may further include a pressure sensor which is provided in the gas recovery chamber of the carriage and detects the pressure of the gas recovery chamber, and a second determination unit which determines whether depressurization of the gas recovery chamber is performed by the depressurization unit, according to the pressure detected by the pressure sensor. According to this embodiment of the liquid ejecting apparatus, it is possible to accurately perform the depressurization process of the gas recovery chamber according to the actual pressure of the gas recovery chamber.

Further embodiments of the liquid ejecting apparatus may further include a third determination unit which determines whether depressurization of the gas recovery chamber is performed by the depressurization unit, according to an elapsed time from the depressurization of the gas recovery chamber being previously performed by the depressurization unit. According to this embodiment of the liquid ejecting apparatus, it is possible to accurately perform the depressurization process of the gas recovery chamber at a predetermined frequency while suppressing the complexity of the structure of the liquid ejecting apparatus.

The invention is not limited to a liquid ejecting apparatus and is, for example, applicable to other aspects such as a method of controlling the liquid ejecting apparatus and a program for realizing a function for controlling the liquid ejecting apparatus on a computer. The invention is not limited to the above-described embodiments and can be variously modified without departing the scope of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

In order to clarify the configuration and the operation of the invention, various embodiments of a liquid ejecting apparatus according to the principles of the present invention will be described. In an exemplary embodiment, an ink jet printer, which is an example of a liquid ejecting apparatus, will be described.

Figure 1:
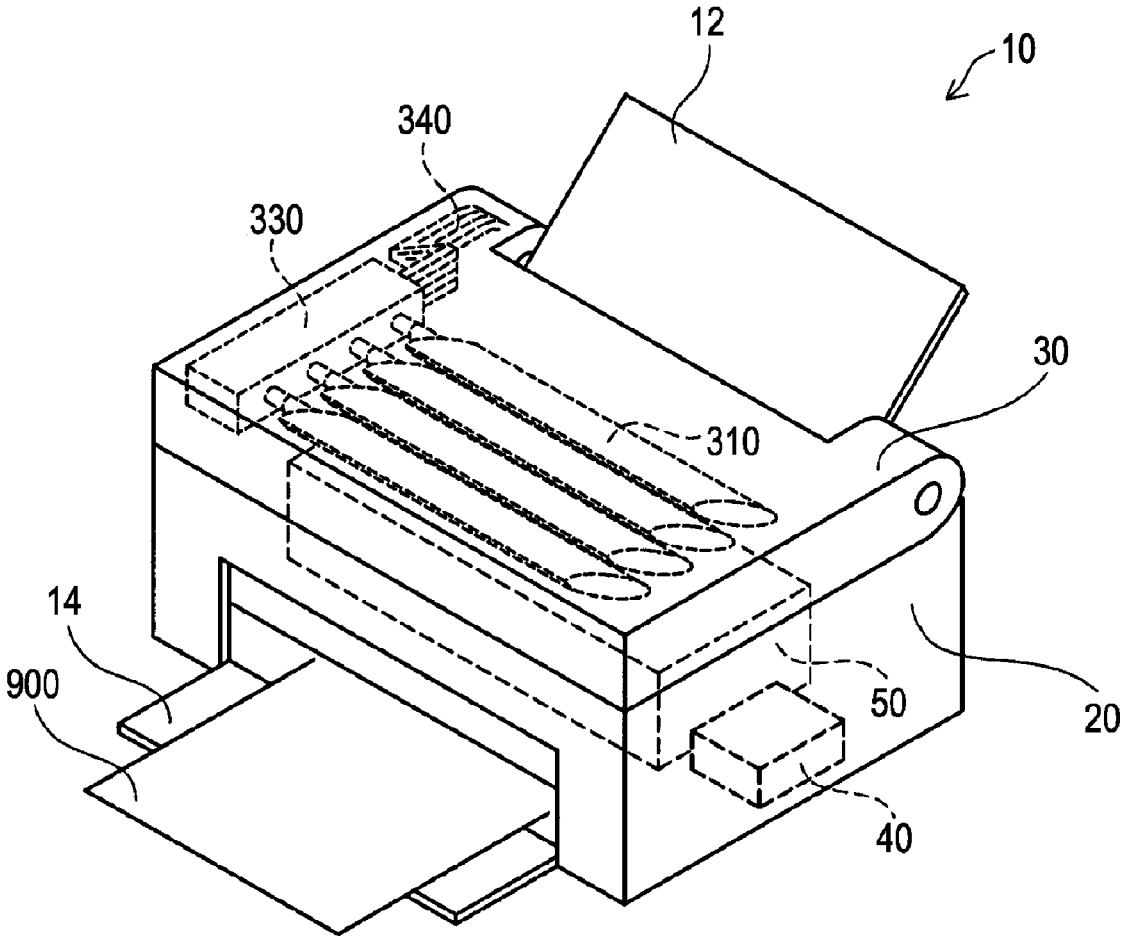
FIG. 1 is a schematic view illustrating the configuration of a printer.

Exemplary Embodiment:

FIG. 1 illustrates a schematic view showing the configuration of a printer 10. The printer 10 may be an ink jet printer which can eject ink droplets and recording characters or figures onto a printing sheet 900, which is an example of a recording medium. The printer 10 includes a main casing body 20 that receives or holds a printing mechanism 50. The printing mechanism 50 may eject the ink droplets onto the printing sheet 900. In the main casing body 20, a feed tray 12 facilitates the feeding of printing sheet 900 into the printing mechanism 50. An ejection tray 14 that holds the printing sheet 900 after it has been ejected from the printing mechanism 50 is also provided. The configuration of the printing mechanism 50 will be described in more detail to follow.

Inside the main casing body 20, a controller 40 for controlling the components of the printer 10 is provided. In the exemplary embodiment, the controller 40 includes application specific integrated circuits (ASIC) having hardware, such as, but not limited to, a central processing unit (CPU), a read only memory (ROM) or a random access memory (RAM). Software for realizing various functions of the printer 10 may be installed in the controller 40. The control operation of the controller 40 will be described in more detail to follow.

An upper casing body 30 for receiving a plurality of ink packs 310 is provided on the main casing body 20. In the exemplary embodiment, the ink packs 310, which receive or hold inks of respective colors, are formed by a flexible sheet in a rectangular bag shape having an elliptical cross-section. Feed ports for ejecting the inks are formed at one side of the short sides of the ink packs 310. In addition, the plurality of ink packs 310 are kept in a state in which one side of the long sides thereof are raised so as to obliquely overlap each other. In the exemplary embodiment, four ink packs 310 including the colors of black, cyan, magenta and yellow are received in the upper casing body 30. In other embodiments, additional ink packs 310 including other colors may also be implemented or less than four ink packs 310 may be implemented. For example, in one embodiment six ink packs 310 including the colors of light cyan and light magenta in addition to the four colors previously mentioned, may be received in the upper casing body 30.

In the upper casing body 30, an ink supply unit 330 connected to the ink packs 310 in order to eject the inks is provided. The ink supply unit 330 is also connected to a supply tube 340 that forms a liquid channel configured to flow the inks from the ink packs 310 to the ink supply unit 330 and then to the printing mechanism 50. The supply tube 340 can be manufactured by a material having an air-permeable property, for example, olefin-based or styrene-based thermoplastic elastomer. Other suitable materials may also be implemented as circumstances warrant.

Figure 2:
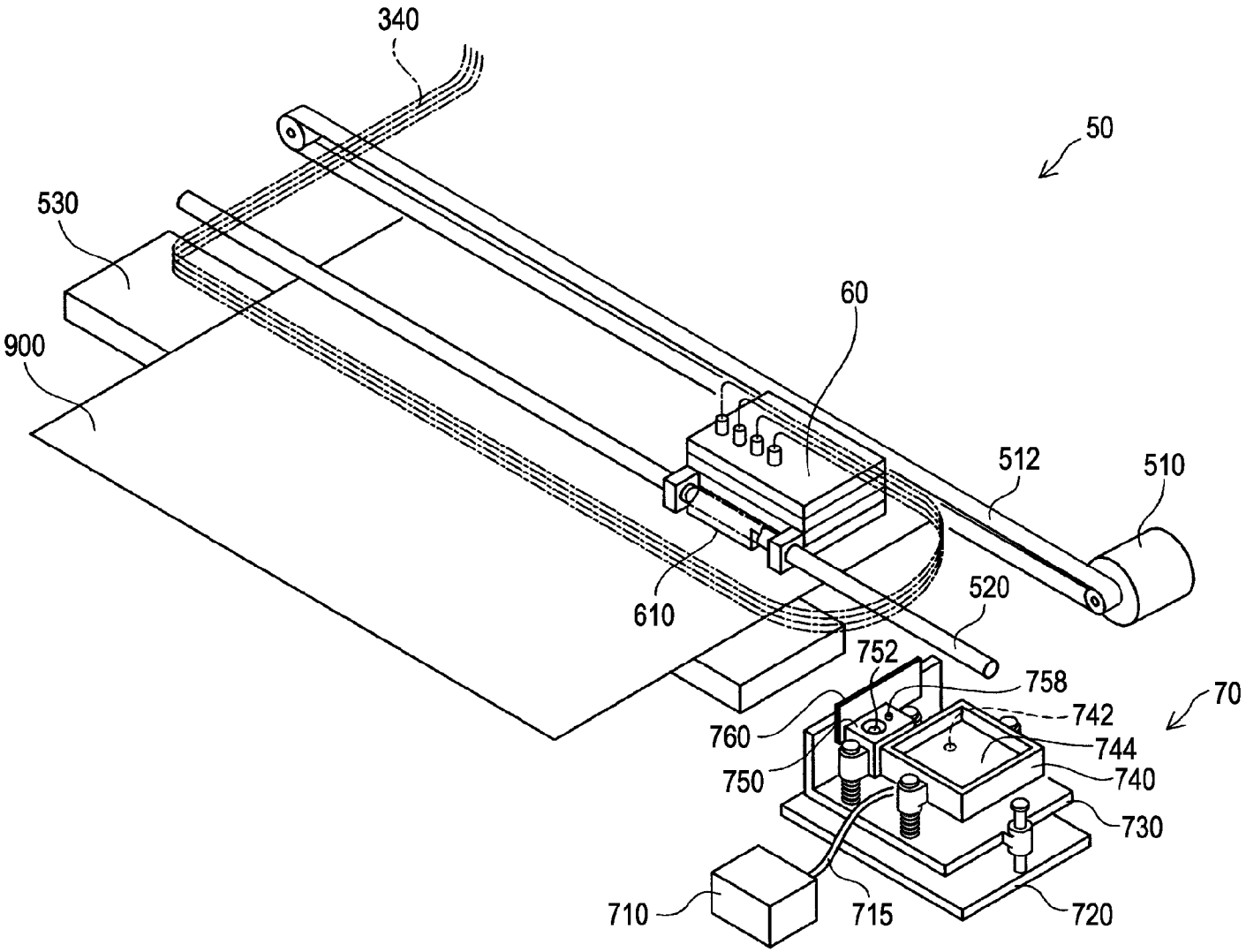
FIG. 2 illustrates the configuration of a printing mechanism of the printer illustrated in FIG. 1.

FIG. 2 is illustrates the configuration of the printing mechanism 50 of the printer 10. The printing mechanism 50 includes a rectangular platen 530 arranged in a printing area in which ink droplets are ejected onto the printing sheet 900. On the platen 530, the printing sheet 900 is fed by a sheet transferring mechanism (not shown). The printing mechanism 50 also includes a carriage 60 connected to the supply tube 340. The carriage 60 is movably supported in the longitudinal direction of the platen 530 along a guide rod 520 and is driven via a timing belt 512 by a carriage motor 510, which is an example of a carriage driver. Accordingly, the carriage 60 is reciprocally moved on the platen 530 in the longitudinal direction. In the main casing body 20, to one side of the printing area, a non-printing area includes a home position for the carriage 60 when the carriage is waiting to be used. A maintenance mechanism 70 for maintaining the carriage 60 is provided at the home position. The maintenance mechanism 70 will be described in more detail to follow.

Figure 3A:
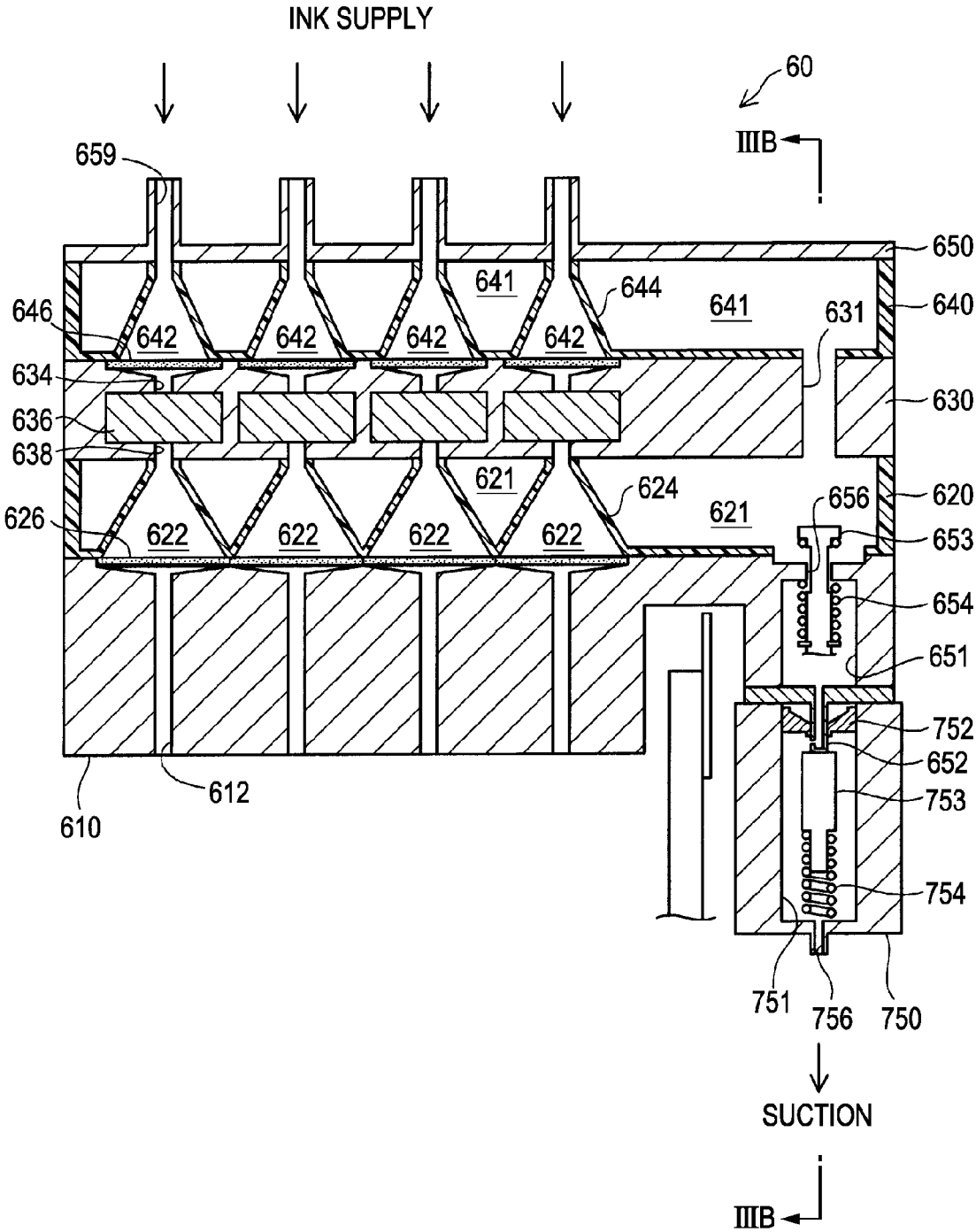
FIG. 3A illustrates the internal configuration of a carriage.
Figure 3B:
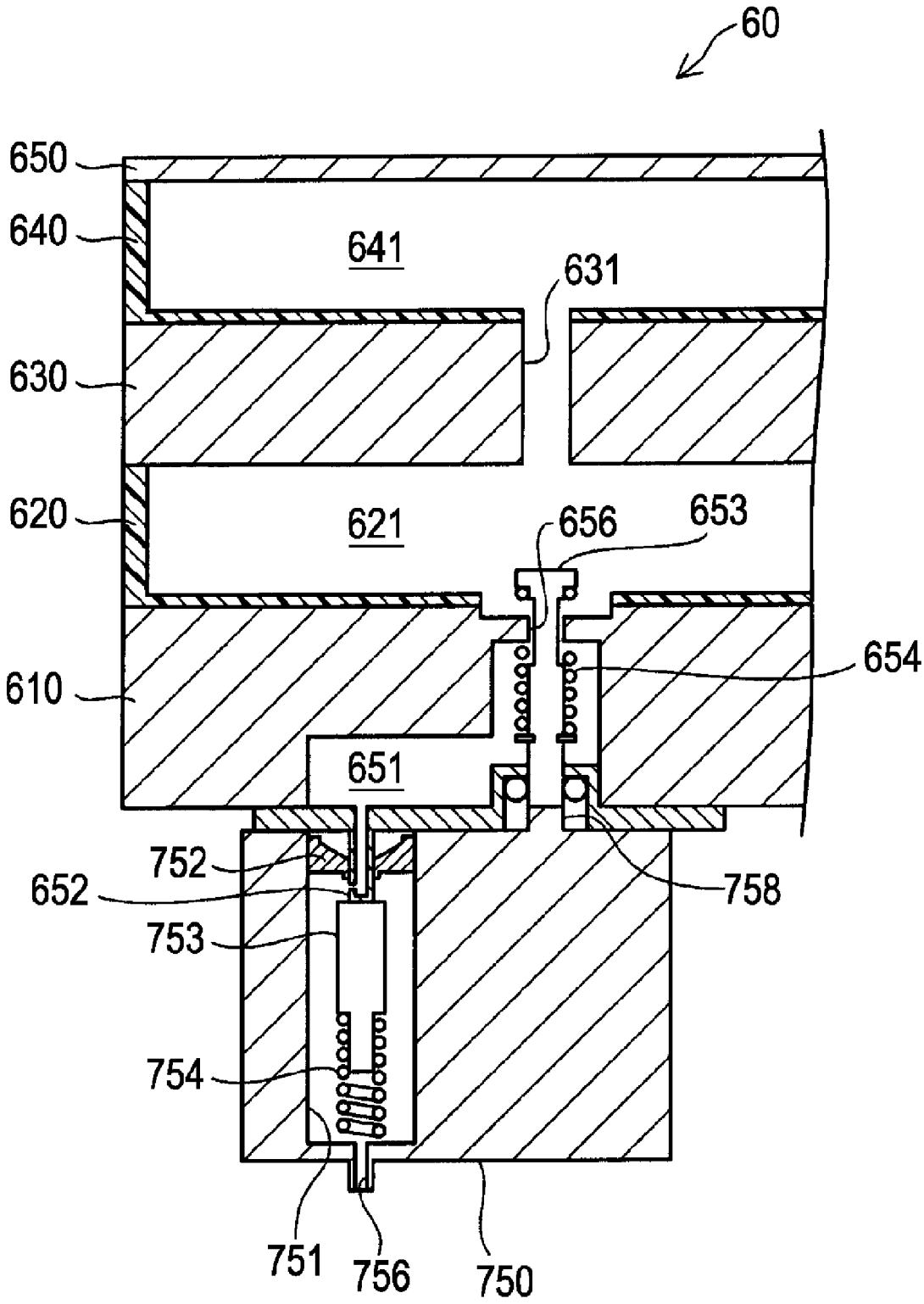
FIG. 3B is a cross-sectional view of the carriage of FIG. 3A connected to an attachment/detachment connection, which is taken along line IIIB-IIIB of FIG. 3A.
Figure 3C:
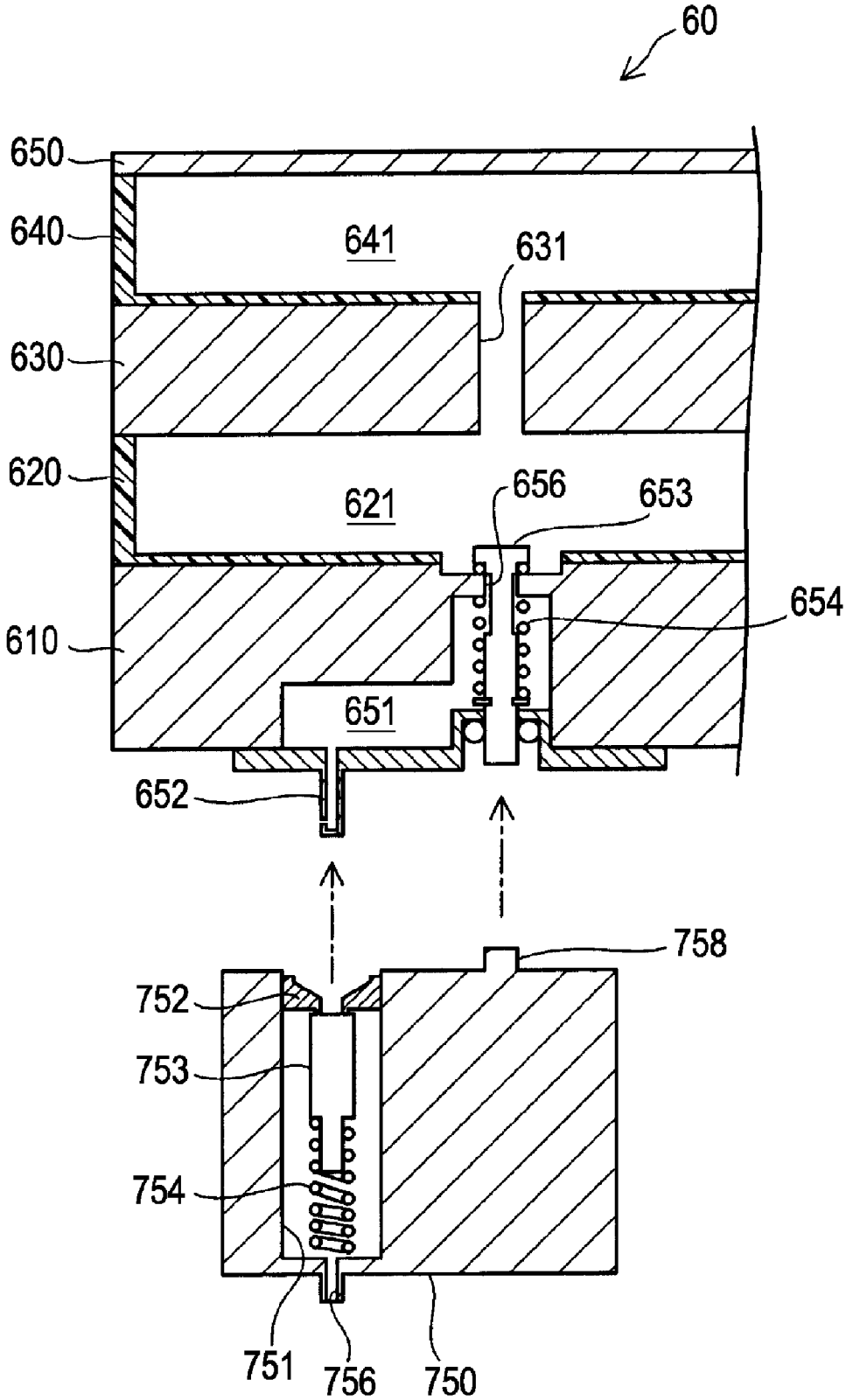
FIG. 3C is a cross-sectional view of the carriage of FIG. 3A connected to an attachment/detachment connection, which is taken along line IIIC-IIIC of FIG. 3A.

FIG. 3A illustrates the internal configuration of the carriage 60. FIG. 3B illustrates a cross-sectional view of the carriage 60 connected to an attachment/detachment connection 750, which is taken along line IIIB-IIIB of FIG. 3A. FIG. 3C illustrates a cross-sectional view of the carriage 60 connected to an attachment/detachment connection 750, which is taken along line IIIC-IIIC of FIG. 3A. A recording head 610 that ejects the ink droplets from nozzles 612 by expansion/contraction of a piezoelectric vibrator (not shown) is provided below the carriage 60. In the exemplary embodiment, in the recording head 610, four nozzle groups composed of a plurality of nozzles 612 are formed in correspondence with the inks of four colors. A second carriage member 620, a third carriage member 630, a fourth carriage member 640 and a fifth carriage member 650 are sequentially laminated above the recording head 610.

The fifth carriage member 650 comprises the upper surface of the carriage 60 and includes ink introduction ports 659, which are connected to the supply tube 340 and form portions of the ink channels. The four ink introduction ports 659 correspond to the inks of four colors.

The fourth carriage member 640 is laminated between the fifth carriage member 650 and the third carriage member 630 and includes upstream trap chambers 642 connected with the ink introduction ports 659 and also includes a gas recovery chamber 641 adjacent to the upstream trap chambers 642 with a gas permeable wall 644 interposed therebetween. Each of upstream trap chambers 642 has a truncated conical shape such that the width of the ink channel expands from the fifth carriage member 650 to the third carriage member 630.

In the exemplary embodiment, the four upstream trap chambers 642 correspond to the inks of four colors. Further, the gas recovery chamber 641 is shared by and adjacent to the plurality of upstream trap chambers 642 with the gas permeable wall 644 interposed therebetween. In addition, the gas permeable wall 644 is integrally formed of a gas permeable material such as polyacetal, polypropylene or polyphenylene ether, with other partition walls in the fourth carriage member 640 for partitioning the outside of the carriage 60 and the gas recovery chamber 641. The thickness of the gas permeable wall 644 is typically smaller than that of the other partition walls in the fourth carriage member 640. The material of the fourth carriage member 640 has a gas permeable coefficient of 5 $cc \cdot mm/m^2 \cdot day \cdot atm$ or more and a moisture permeable coefficient of 2 $g = mm/m^2 \cdot day \cdot atm$ or less. In the exemplary embodiment, the gas permeable wall 644 has an area of about 1 $cm^2$ and a thickness of about 1 mm. In the exemplary embodiment, the fourth carriage member 640 is an integrally formed member, but, in another embodiment, the gas permeable wall 644 may be formed of a material having a higher gas permeable material than that of the other partition walls.

The third carriage member 630 is laminated between the fourth carriage member 640 and the second carriage member 620 and includes ink channels 634 that are connected to the upstream trap chambers 642 via a filter 646. The third carriage member also includes pressure regulating valves 636 for decreasing the pressure of the inks that flow to the recording head 610, and ink channels 638 for that flow the inks from the pressure regulating valves 636 to the recording head 610. In the exemplary embodiment, the third carriage member 630 includes four ink channels 634, four pressure regulating valves 636 and four ink channels 638 in correspondence with the inks of four colors.

The second carriage member 620 is laminated between the third carriage member 630 and the recording head 610 and includes downstream trap chambers 622 that are connected to the ink channels 638 via a filter 626 and a gas recovery chamber 621 adjacent to the downstream trap chambers 622 with a gas permeable wall 624 interposed therebetween. Each of downstream trap chambers 622 has a truncated conical shape such that the width of the ink channel expands from the third carriage member 630 to the recording head 610.

In the exemplary embodiment, the second carriage member 620 includes four downstream trap chambers 622 corresponding to the inks of four colors. In addition, the gas recovery chamber 621 is shared by and adjacent to the plurality of downstream trap chambers 622 with the gas permeable wall 624 interposed therebetween. Further, the gas permeable wall 624 is integrally formed of a gas permeable material such as polyacetal, polypropylene or polyphenylene ether, with other partition walls in the second carriage member 620 for partitioning the outside of the carriage 60 and the gas recovery chamber 621. The thickness of the gas permeable wall 624 is typically smaller than that of the other partition walls in the second carriage member 620. The material of the second carriage member 620 has a gas permeable coefficient of 5 cc=mm/m$^2$·day·atm or more and a moisture permeable coefficient of 2 g=mm/m$^2$·day·atm or less. In the exemplary embodiment, the gas permeable wall 624 has an area of about 1 cm$^2$ and a thickness of about 1 mm. Further, the second carriage member 620 is an integrally formed member, but, in another embodiment, the gas permeable wall 624 of the second carriage member 620 may be formed of a material having a higher gas permeable material than that of the other partition walls.

In the carriage 60, a communication path 631 that connects the gas recovery chamber 621 with the gas recovery chamber 641 is formed and a depressurization relay chamber 651 that is connected via an opening 656 is formed below the gas recovery chamber 621. As shown in FIG. 3C, the depressurization relay chamber 651 communicates with the outside of the carriage 60 via a hollow needle 652 having an opening at a side surface. As shown in FIGS. 3B and 3C, in the opening 656 a hermetically sealing valve 653 for sealing the opening 656 by a coil spring 654 is provided. As shown in FIG. 3B, the hermetically sealing valve 653 opens the opening 656 when being pressurized from the outside of the carriage 60 by force against the coil spring 654.

Returning to FIG. 2, the maintenance mechanism 70 includes a head cap 740 for covering the lower surface of the recording head 610 in which the nozzles 612 are arranged, an attachment/detachment connection 750 for detachably connecting the gas recovery chamber 621 and the gas recovery chamber 641 via the depressurization relay chamber 651 of the carriage 60, a wiper blade 760 for wiping off the ink adhered to the lower surface of the recording head 610, and a vacuum pump 710, which is an example of a depressurization unit for applying negative pressure to the head cap 740 and the attachment/detachment connection 750 via a vacuum tube 715. The head cap 740, the attachment/detachment connection 750, the wiper blade 760 and the elevation base 730 are arranged to a base 720 that is fixed to the main casing body 20 in an elevatable manner.

Figure 4:
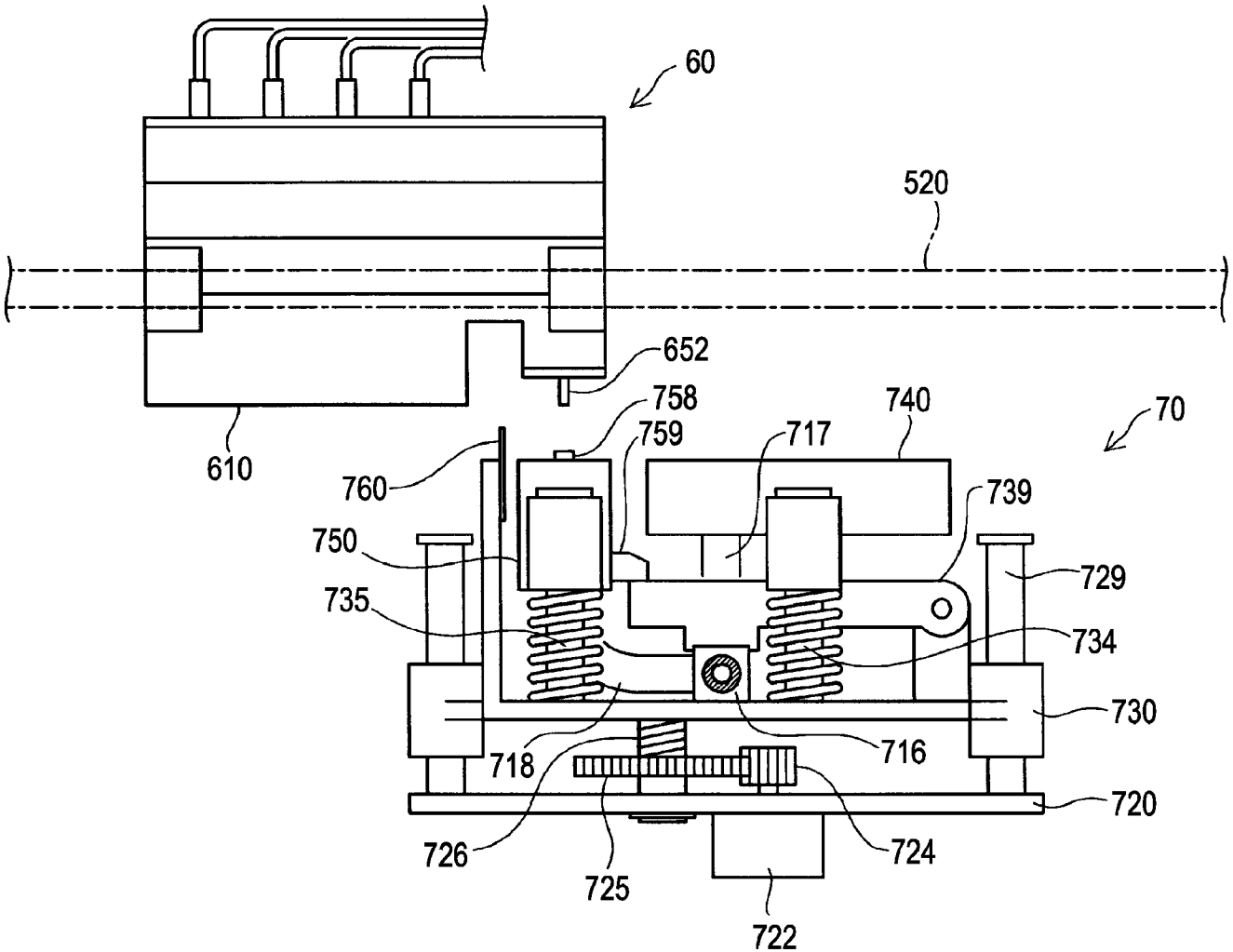
FIG. 4 illustrates a state in which the carriage of FIG. 3A is moved to a position which can be connected to an attachment/detachment connection.
Figure 5:
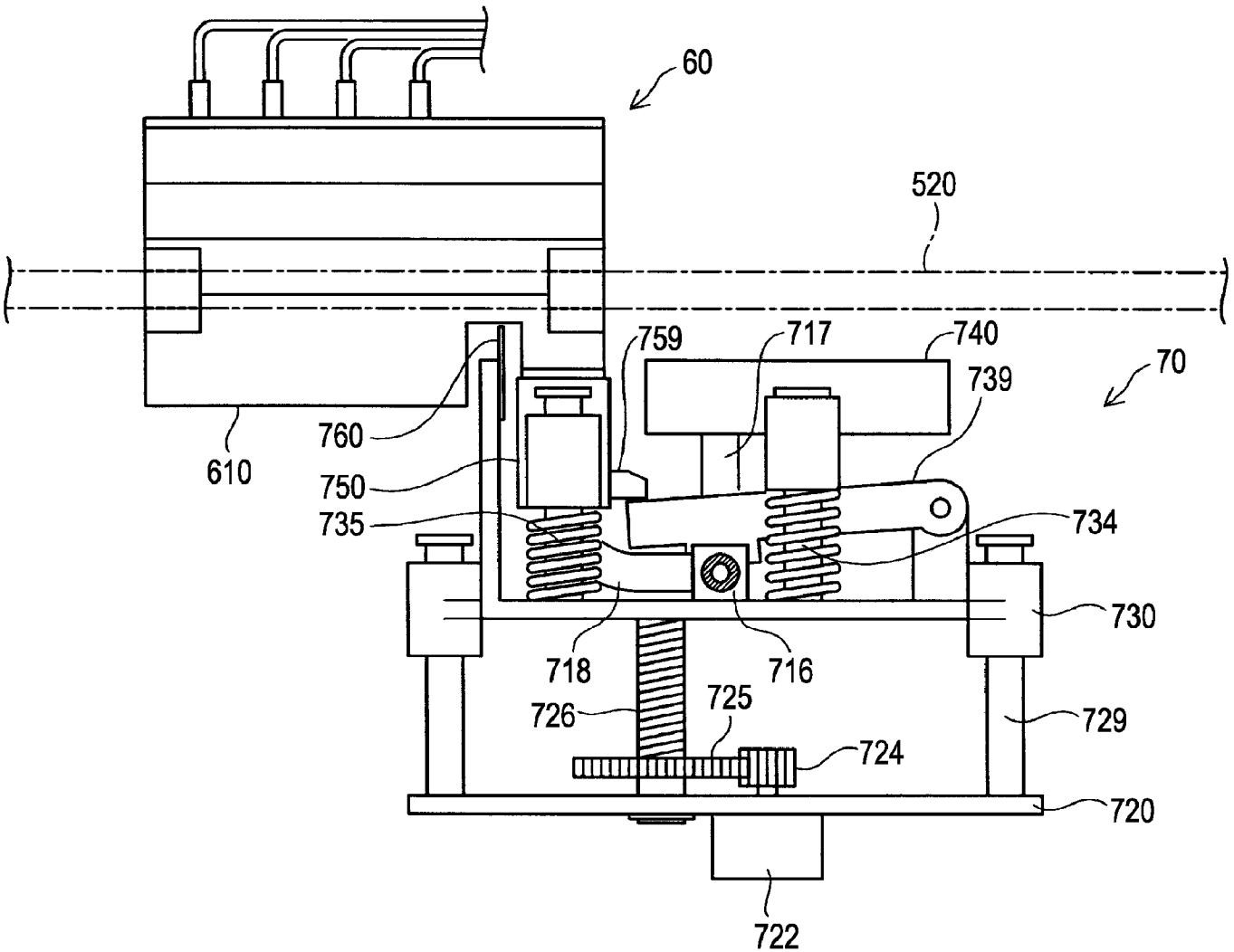
FIG. 5 illustrates a state in which an attachment/detachment connection is raised and is connected to the carriage of FIG. 3A.

FIG. 4 illustrates a state in which the carriage 60 is moved to a position which can be connected to the attachment/detachment connection 750. FIG. 5 illustrates a state in which the attachment/detachment connection 750 is raised and is connected to the carriage 60.

In the elevation base 730 of the maintenance mechanism 70, an energizing support unit 734 for energizing and supporting the head cap 740 in an upward position and an energizing support unit 735 for energizing and supporting the attachment/detachment connection 750 in an upward position are provided. An elevation motor 722 is provided in the base 720 of the maintenance mechanism 70 and, when the elevation motor 722 rotates a lead screw 726 via a transfer gear 724 and a transfer gear 725, the elevation base 730 is engaged with the lead screw 726 and elevates by the rotation of the lead screw 726.

In the maintenance mechanism 70, a branch unit 716 for branching the vacuum tube 715 to the head cap 740 and the attachment/detachment connection 750 is provided. A branch tube 717 is connected between the branch unit 716 and the head cap 740 and a branch tube 718 is connected between the branch unit 716 and the attachment/detachment connection 750. A blocking lever 739 engaged with a convex portion 759 provided in the attachment/detachment connection 750 is horizontally arranged in the midstream of the branch tube 717 connected to the head cap 740. As shown in FIG. 5, if the carriage 60 is connected to the attachment/detachment connection 750, the blocking lever 739 is moved downward by the convex portion 759 so as to crush the branch tube 717, and thus functions as a first opening preventing unit by blocking the supply of the negative pressure to the head cap 740. Accordingly, the supplied negative pressure is sucked to a depressurization provision chamber 751 without being leaked from the head cap 740.

As shown in FIGS. 3A, 3B and 3C, in the attachment/detachment connection 750 of the maintenance mechanism 70, the depressurization provision chamber 751 is connected to a connection port 756 that is connected to the branch tube 718. A packing 752 having a through-hole closely fitted into the hollow needle 652 of the carriage 60 is fitted into the upper side of the depressurization provision chamber 751. In the depressurization provision chamber 751, a hermetically sealing valve 753 coupled to the packing 752 by a coil spring 754 is provided. The hermetically sealing valve 753 openably seals the through-hole of the packing 752 according to the insertion and the separation of the hollow needle 652, and is closely attached to the packing 752 so as to function as an example of a second opening preventing unit when the hollow needle 652 is separated from the attachment/detachment connection 750. As shown in FIGS. 3B and 3C, on the upper surface of the attachment/detachment connection 750, an opening convex portion 758 pressurizes the hermetically sealing valve 653 of the carriage 60 when the attachment/detachment connection 750 is raised to be connected to the carriage 60.

As shown in FIGS. 3A and 3B, when the attachment/detachment connection 750 is raised to be connected to the carriage 60, the depressurization provision chamber 751 of the attachment/detachment connection 750 couples with the depressurization relay chamber 651 of the carriage 60 and the depressurization relay chamber 651 communicates or connects with the gas recovery chamber 621 and the gas recovery chamber 641. Accordingly, the pressures of the gas recovery chamber 621 and the gas recovery chamber 641 are decreased to pressures lower than the pressures of the downstream trap chamber 622 and the upstream trap chamber 642 by receiving the negative pressure from the vacuum pump 710. In the exemplary embodiment, a pressure difference between the downstream trap chamber 622, the upstream trap chamber 642, and the gas recovery chambers 621 and 641 is maintained in a range of about 5 kpascal to about 40 kpascal at a room temperature, and, if the pressure difference is decreased about 5 kpascal, depressurization is performed such that the pressure difference becomes about 40 kpascal.

Figure 6:
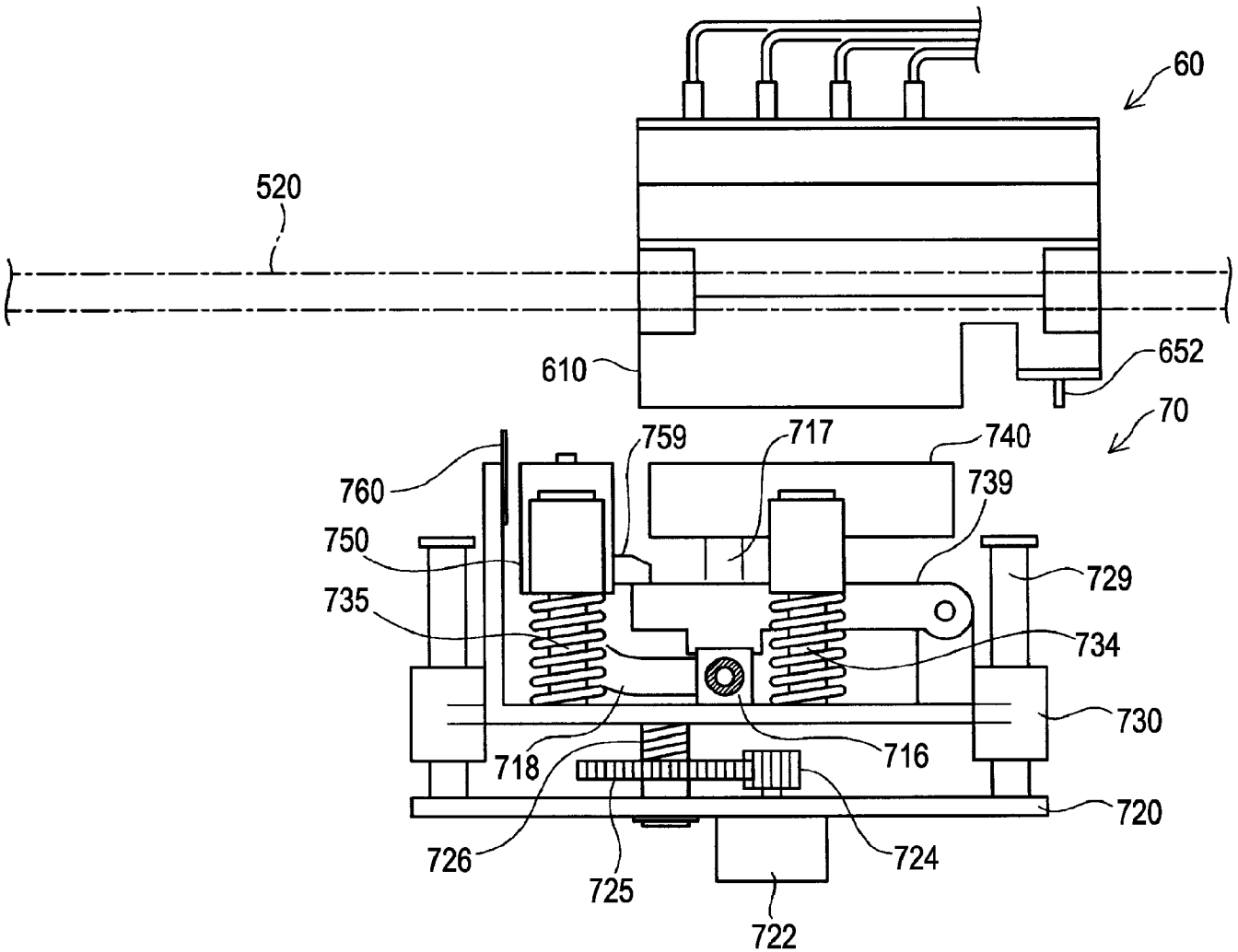
FIG. 6 illustrates a state in which the carriage of FIG. 3A is moved to a position which can be connected to a head cap.
Figure 7:
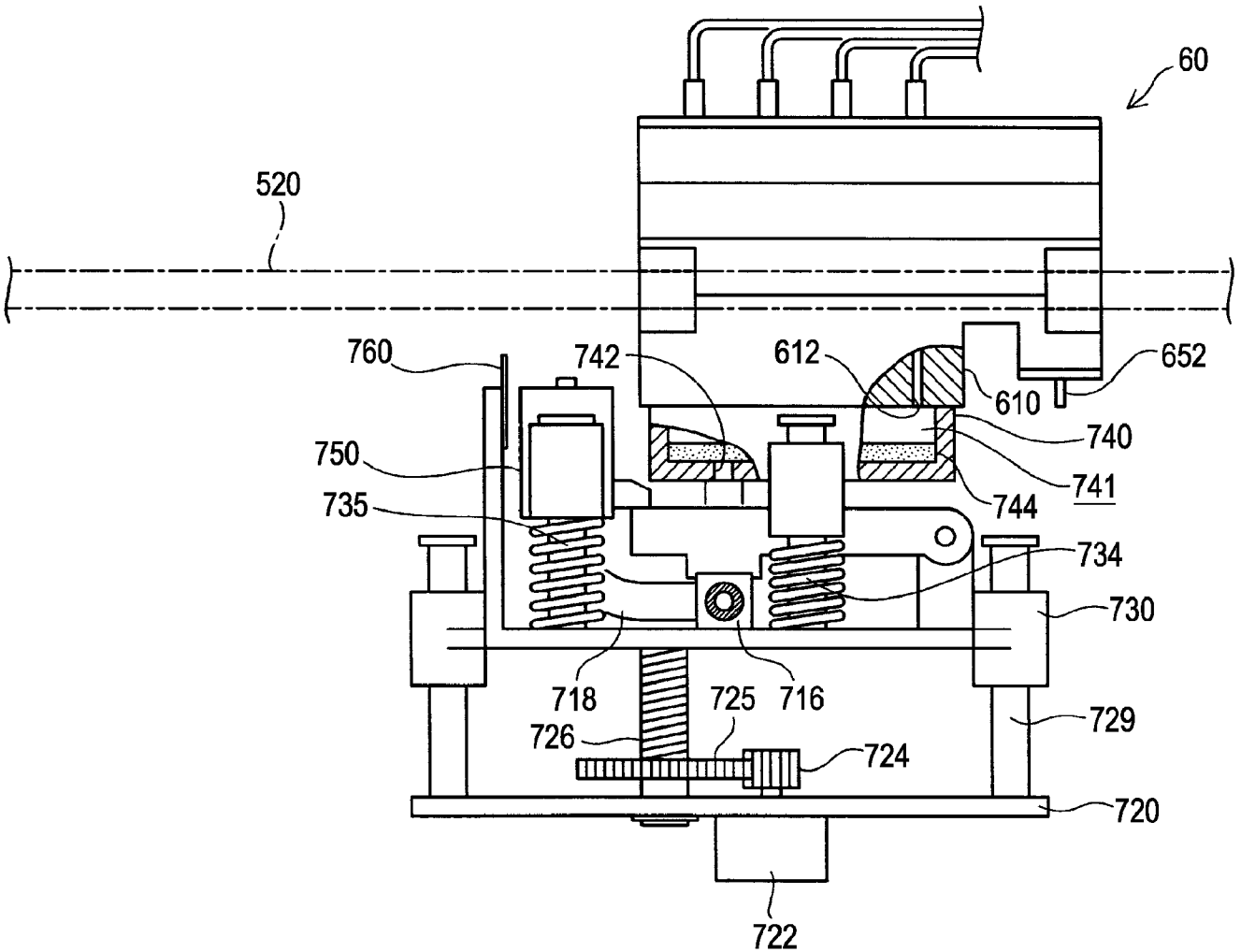
FIG. 7 illustrates state in which a head cap is raised and is connected to the carriage of FIG. 3A.

FIG. 6 illustrates a state in which the carriage 60 is moved to a position which can be connected to the head cap 740. FIG. 7 illustrates a state in which the head cap 740 is raised and is connected to the carriage 60. In the exemplary embodiment, a position where the carriage 60 is connected to the head cap 740 is different from a position where the carriage 60 is connected to the attachment/detachment connection 750. The head cap 740, which is an example of a head cleaner, forms an ink suction chamber 741 in communication with the connection port 742, which connects the branch tube 717 with the lower surface of the recording head 610, when the head cap 740 is raised to be connected to the carriage 60. Accordingly, the pressure of the ink suction chamber 741 is decreased to a pressure lower than that of the nozzles 612 by receiving the negative pressure from the vacuum pump 710. The negative pressure from the vacuum pump 710 can be decreased by closing the attachment/detachment connection 750 via the hermetically sealing valve 753. On the bottom surface of the ink suction chamber 741, a sponge 744 is provided for absorbing the ink sucked to the ink suction chamber 741 from the nozzles 612.

Figure 8:
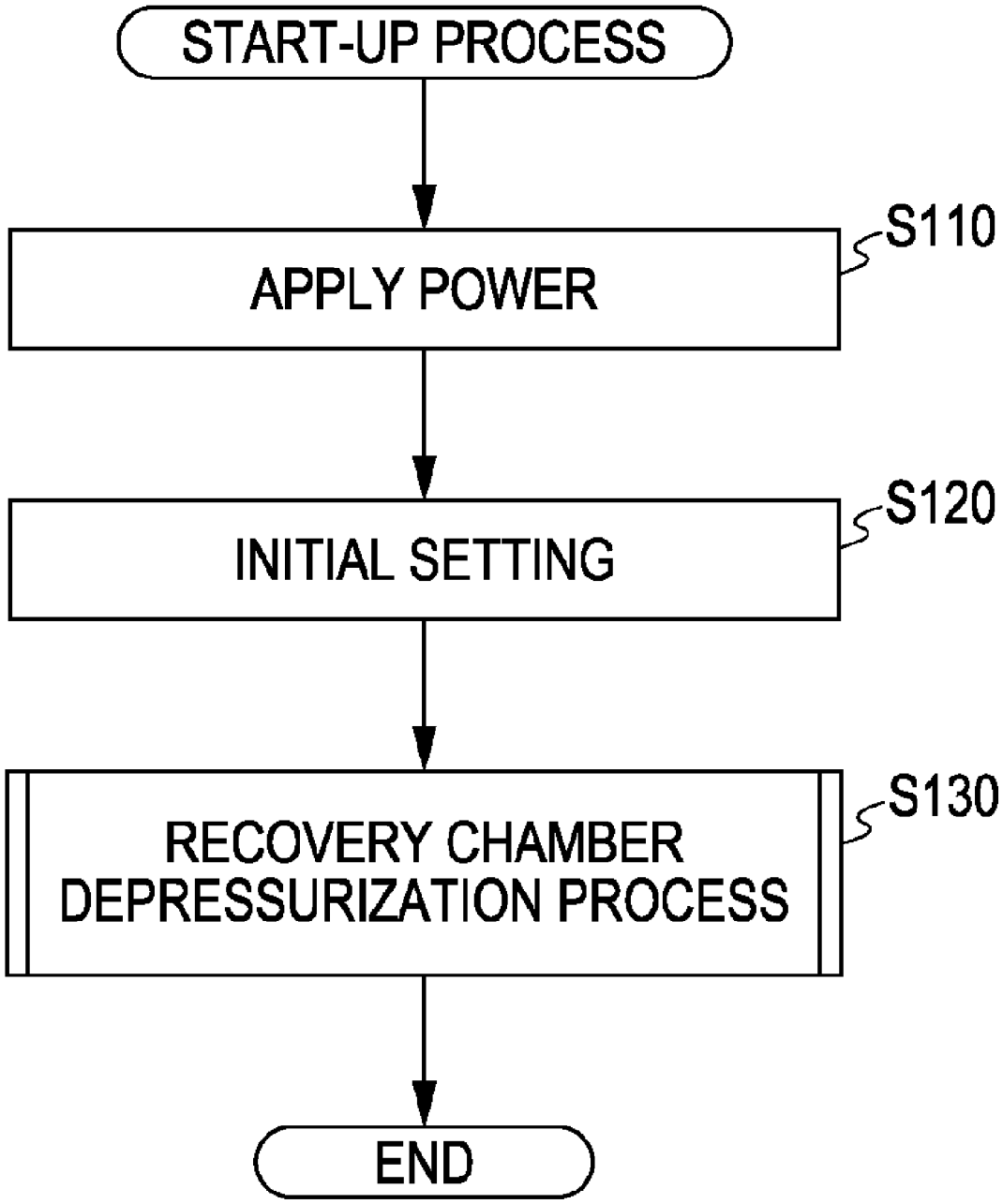
FIG. 8 illustrates a flowchart showing a start-up process executed by a controller of a printer.

FIG. 8 is a flowchart illustrating a start-up process executed by the controller 40 of the printer 10. In the exemplary embodiment, the start-up process of FIG. 8 is realized by an operation based on software of the CPU of the controller 40. In the exemplary embodiment, when power is applied to the printer 10, the controller 40 starts the start-up process of FIG. 8.

When power is applied to the printer 10 (step S110) the controller 40 performs an initial setting process (step S120). Thereafter, the controller 40 performs a recovery chamber depressurization process of depressurizing the gas recovery chamber 621 and the gas recovery chamber 641 (step S130). In the recovery chamber depressurization process (step S130), the controller 40 transmits a control signal to the carriage motor 510 and moves the carriage 60 to a position shown in FIG. 4. Thereafter, the controller 40 transmits a control signal to the elevation motor 722 and raises the attachment/detachment connection 750 to a position shown in FIG. 5 so as to be connected to the carriage 60. Next, the controller 40 transmits a control signal to the vacuum pump 710 so as to generate the negative pressure by the vacuum pump 710.

In the exemplary embodiment, a volume decreasing speed for decreasing the volume of any air bubbles filled in the downstream trap chamber 622 and the upstream trap chamber 642 by the recovery of the gas recovery chambers 621 and 641 is set to be larger than a volume increasing speed for increasing (growing) the volume of any air bubbles in the downstream trap chamber 622 and the upstream trap chamber 642 with any air bubbles introduced from the upstream side of the ink channel. In more detail, various types of balances such as the pressure difference between the downstream trap chamber 622 and the upstream chamber 642 and the gas recovery chambers 621 and 641, the areas of the gas permeable walls 624 and 644, the thicknesses of the gas permeable walls 624 and 644, the gas permeable coefficients of the materials forming the gas permeable walls 624 and 644, and the moisture permeable coefficients of the materials forming the gas permeable walls 624 and 644 are adjusted such that the volume of the permeated gas per 24 hours (day) in the gas permeable walls 624 and 644 is, for example, 0.05 $mm^3$/day or more and the volume of the permeated moisture is 0.10 mg/day or less.

According to the above-described printer 10, since the downstream trap chamber 622, the upstream trap chamber 642 and the gas recovery chambers 621 and 641 are efficiently arranged with respect to the ink channel and the gas recovery chambers 621 and the 641 are detachably connected to the vacuum pump 710 by the attachment/detachment connection 750, it is possible to efficiently eliminate any air bubbles mixed into the ink in the ink channel while suppressing the enlargement of the carriage 60 and the complexity of the structure. Since the hermetically sealing valve 653 is provided in the opening 656 that is in communication with the gas recovery chamber 621, the pressure of the gas recovery chamber 621 is maintained in a state of being decreased even while the attachment/detachment connection 750 is separated from the carriage 60. Accordingly, even when the power is turned off, it is possible to eliminate any air bubbles mixed into the ink of the downstream trap chamber 622 or the upstream trap chamber 642.

Further, since the vacuum pump 710 for depressurizing the downstream trap chamber 622 and the upstream trap chamber 642 can be used for depressurizing the ink suction chamber 741, it is possible to simplify the configuration of the printer 10. In the upstream trap chamber 642, any air bubbles which reach the pressure regulating valve 636 can be eliminated and, in the downstream trap chamber 622, any air bubbles generated by the action of the pressure regulating valve 636 can be eliminated. Since the recovery chamber depressurization process (step S130) is performed when the power is applied to the printer 10, the depressurization of the gas recovery chambers 621 and 641 can be accurately performed so as to cope with a situation in which a next depressurization process of the gas recovery chambers 621 and 641 cannot be estimated.

Figure 9:
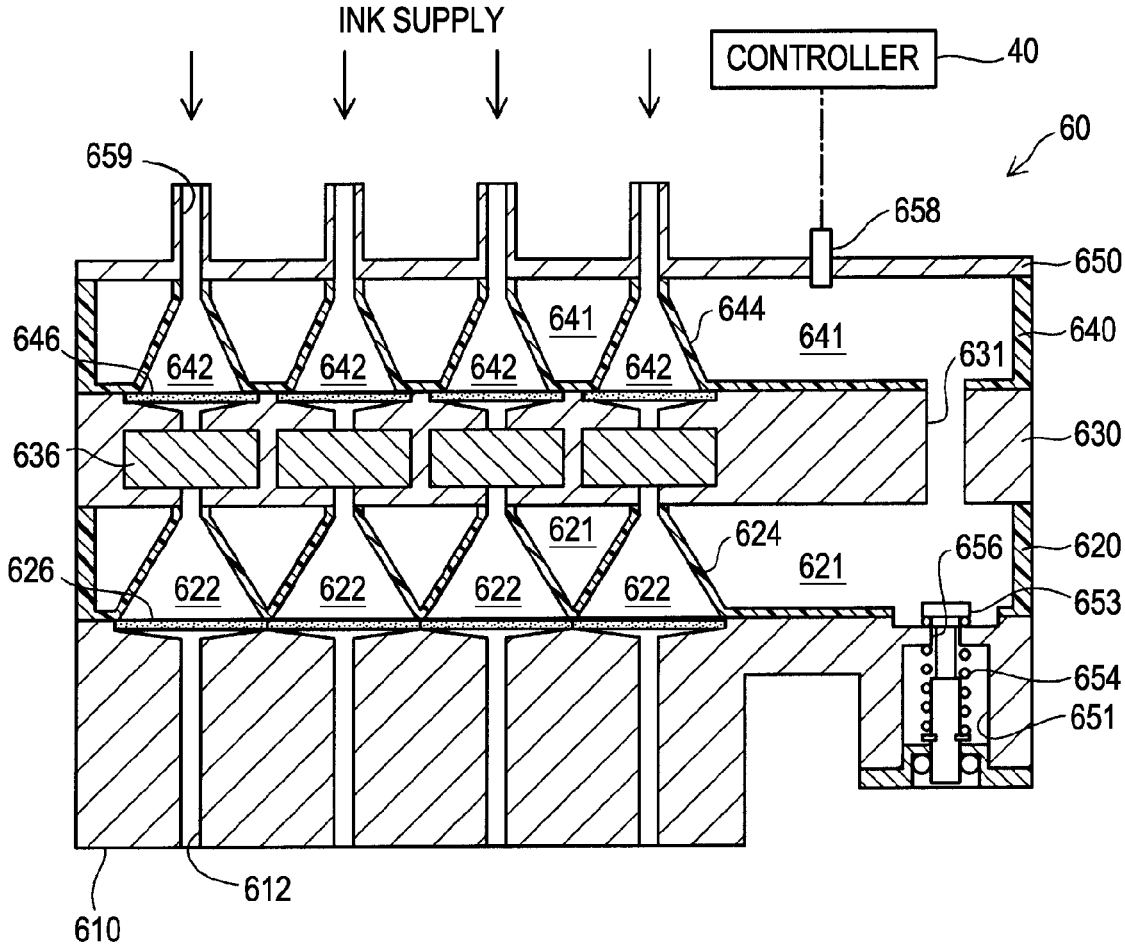
FIG. 9 illustrates the internal configuration of the carriage of FIG. 3A according to a first example.

First Alternative Embodiment:

FIG. 9 illustrates the internal configuration of the carriage 60 according to a first alternative embodiment. The configuration of the printer according to the first alternative embodiment is to the same as the printer 10 of the previously described exemplary embodiment except that a pressure sensor 658 for detecting the pressures of the gas recovery chambers 621 and 641 is provided in the carriage 60. As shown, the pressure sensor 658 is electrically connected to the controller 40.

Figure 10:
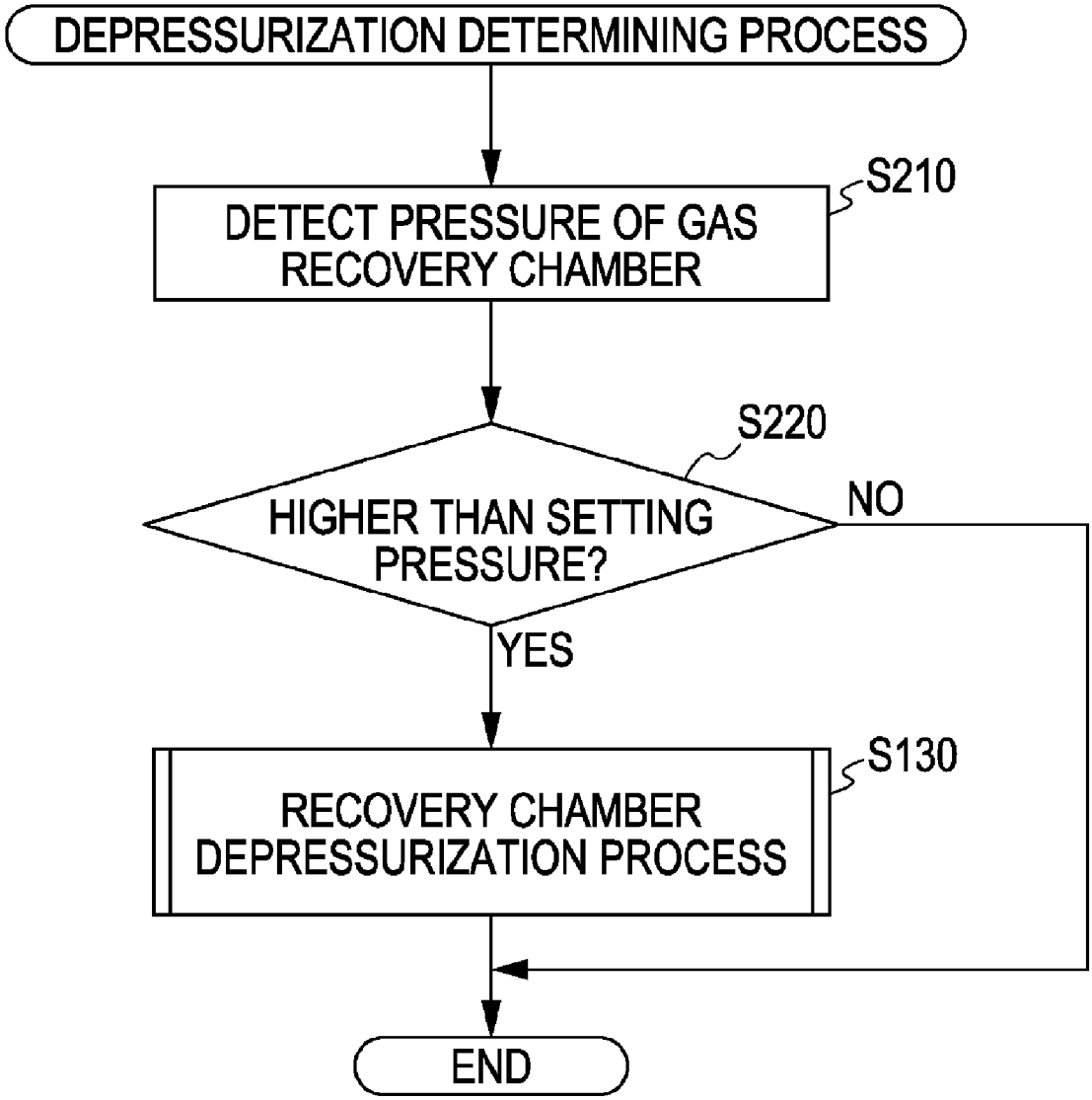
FIG. 10 illustrates a flowchart showing a depressurization determining process executed by a controller of a printer according to the first example.

FIG. 10 is a flowchart illustrating a depressurization determining process executed by the controller 40 of the printer 10 according to the first alternative embodiment. In the first alternative embodiment, the depressurization determining process of FIG. 10 is performed by an operation based on software of the CPU of the controller 40. In the first alternative embodiment, the controller 40 periodically performs the depressurization determining process of FIG. 10 when the printing operation is not performed. The controller 40 detects the pressures of the gas recovery chambers 621 and 641 from an output signal of the pressure sensor 658 when the depressurization determining process of FIG. 10 is started (step S210). The controller 40 then performs the recovery chamber depressurization process (step S130) when the pressures of the gas recovery chambers 621 and 641 are higher than a predetermined pressure (Yes in step S220). However, if the pressures of the gas recovery chambers 621 and 641 are not higher than the predetermined pressure, then the recovery chamber depressurization process is not performed (No in step S220). According to the printer of the first alternative embodiment, the recovery chamber depressurization process (step S130) can be accurately performed according to the actual pressures of the gas recovery chambers 621 and 641.

Figure 11:
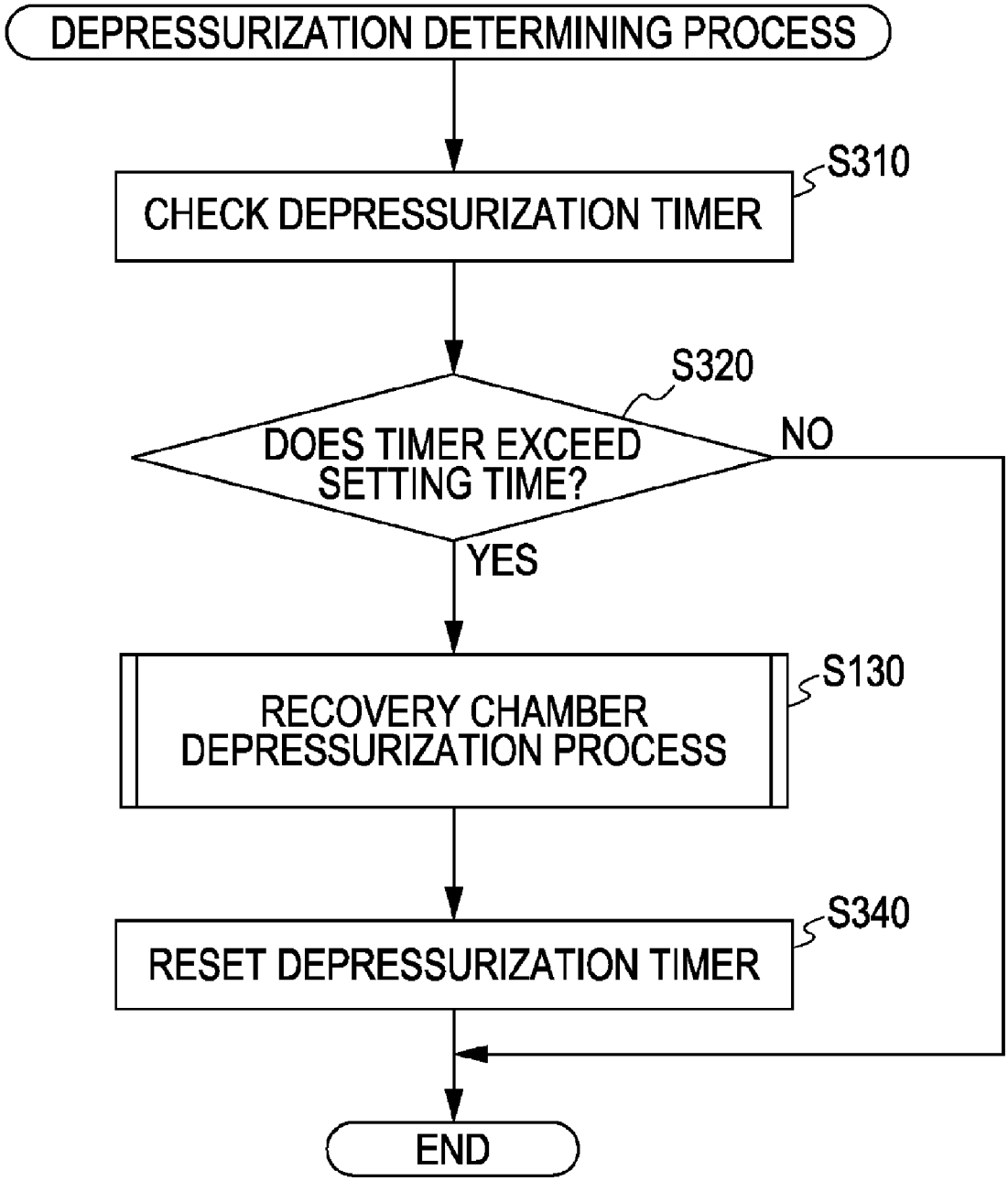
FIG. 11 illustrates a flowchart showing a depressurization determining process executed by a controller of a printer according to a second example.

Second Alternative Embodiment:

The configuration of the printer of a second alternative embodiment is to the same as the printer 10 of the previously described embodiments. FIG. 11 is a flowchart illustrating a depressurization determining process executed by the controller 40 of the printer 10 according to the second alternative embodiment. In the second alternative embodiment, the depressurization determining process of FIG. 11 is performed by an operation based on software of the CPU of the controller 40. In the second alternative embodiment, the controller 40 periodically performs the depressurization determining process of FIG. 11 when the printing operation is not performed.

When the depressurization determining process of FIG. 11 is started, the controller 40 checks a depressurization timer which is reset (step s310) when a previous recovery chamber depressurization process is performed (step S130). If the depressurization time exceeds a predetermined setting period (Yes in step S320), the controller 40 performs the recovery chamber depressurization process (step S130). Thereafter, the controller 40 resets the depressurization time for the next recovery chamber depressurization process (step S130). However, if the depressurization time does not exceed the predetermined setting period, then the recovery chamber depressurization process is not performed (No in step S220). According to the printer of the second alternative embodiment, it is possible to accurately perform the recovery chamber depressurization process (step S130) at predetermined frequency while suppressing the complexity of the structure of the printer.

Third Alternative Embodiment:

Although the position of the carriage 60 relative to the maintenance mechanism 70 varies when carriage 60 is connected to the attachment/detachment connection 750 and when carriage 60 is connected to the head cap 740 in the previously described embodiments, the carriage 60 may be connected at the same position relative to the attachment/detachment connection 750 and the head cap 740.

Figure 12:
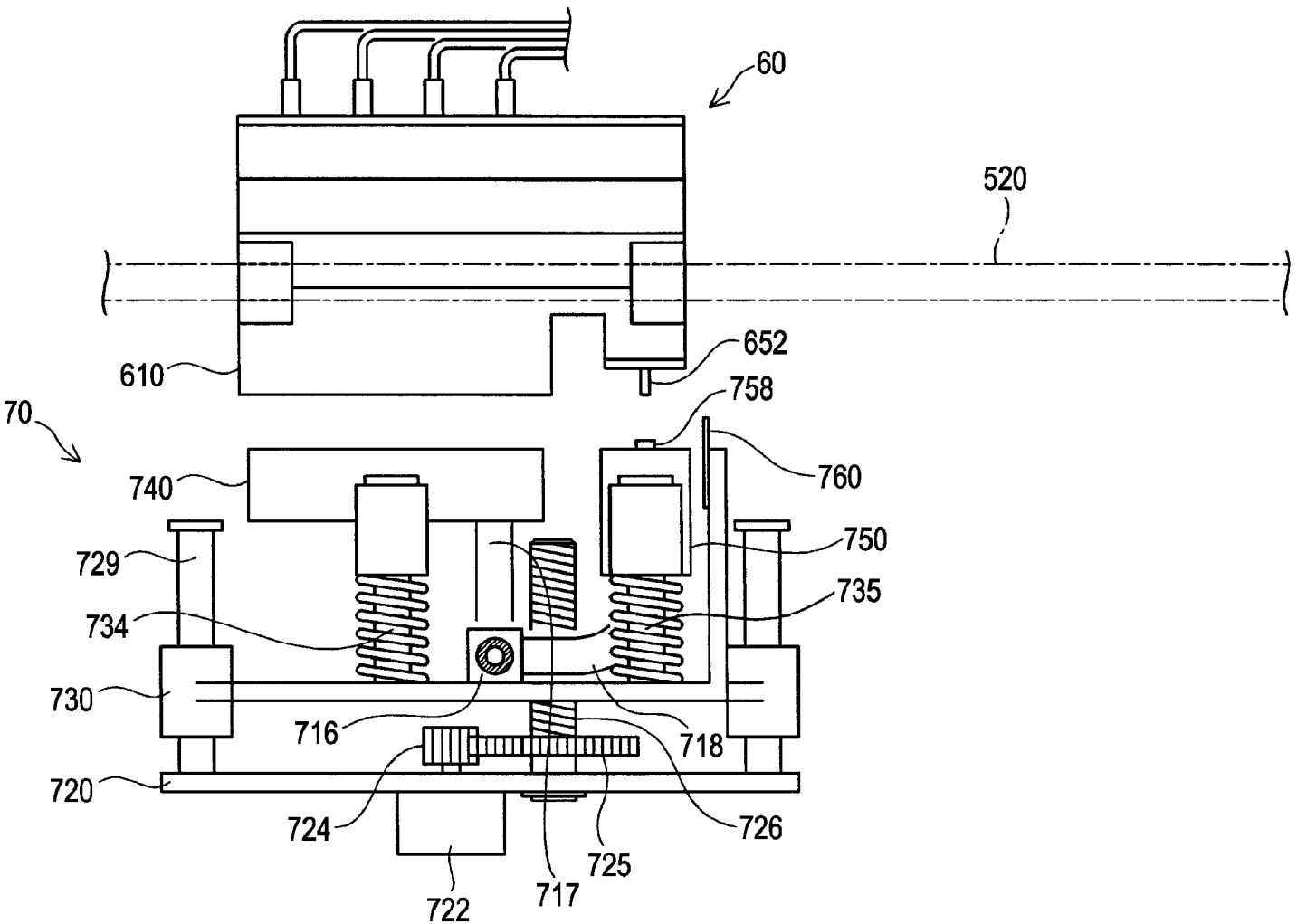
FIG. 12 illustrates a state in which the carriage of FIG. 3A is positioned above a maintenance mechanism, according to a third example.

FIG. 12 illustrates a state in which the carriage 60 is positioned above the maintenance mechanism 70, according to a third alternative embodiment. The printer 10 according to the third alternative embodiment is the same as the previously described embodiments except that the configuration of the maintenance mechanism 70 is different. The maintenance mechanism 70 of the third alternative embodiment is to the same as that of the previously described embodiments except that the positions of the attachment/detachment connection 750 and the head cap 740 are different and the blocking lever 739 is not provided. In the third alternative embodiment, when the carriage 60 is positioned above the maintenance mechanism 70, the attachment/detachment connection 750 is positioned below the hollow needle 652 of the carriage 60 and the head cap 740 is positioned below the recording head 610 of the carriage 60.

Figure 13:
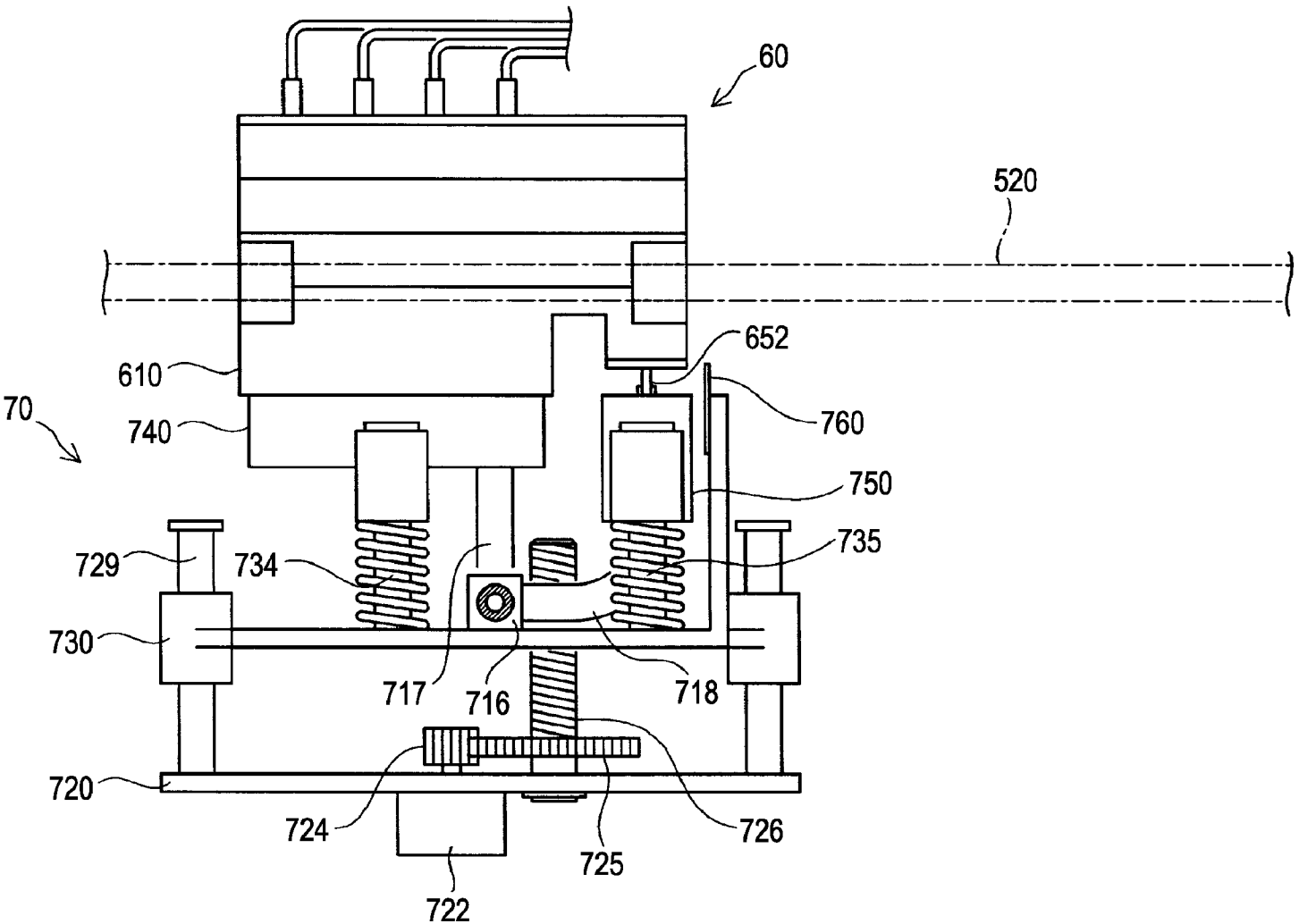
FIG. 13 illustrates a state in which an elevation base is raised from the state shown in FIG. 12 and a head cap is connected to the carriage of FIG. 3A.

FIG. 13 illustrates a state in which an elevation base 730 is raised from the state shown in FIG. 12 and the head cap 740 is connected to the carriage 60. In the third alternative embodiment, when the elevation base 730 is raised, the head cap 740 is connected to the recording head 610 of the carriage 60 and the ink suction chamber 741 is formed between the head cap 740 and the lower surface of the recording head 610. The pressure of the ink suction chamber 741 is decreased to a pressure lower than that of the nozzles 612 by receiving the negative pressure from the vacuum pump 710.

Figure 14:
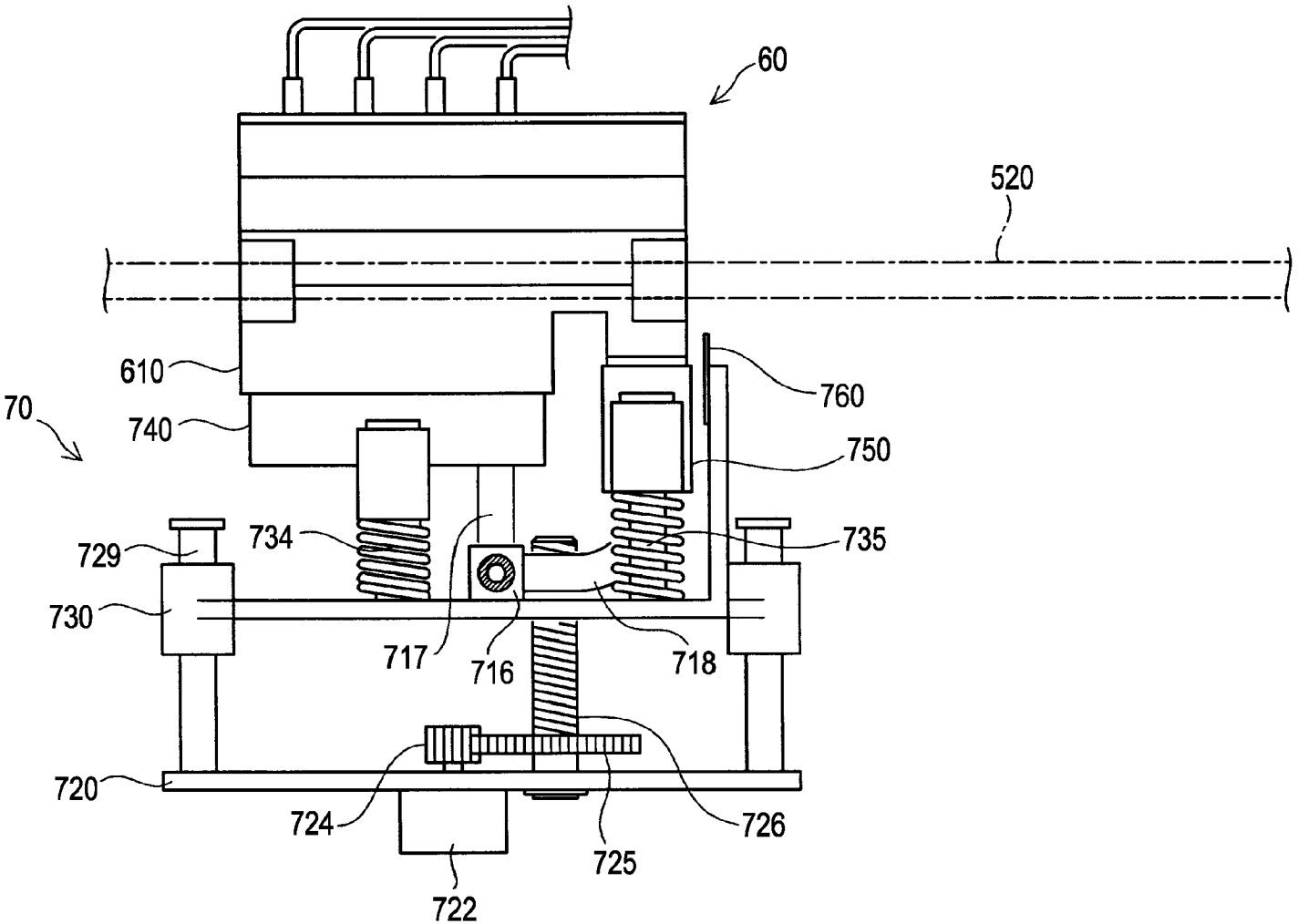
FIG. 14 illustrates a state in which an elevation base is further raised from the state shown in FIG. 13 and an attachment/detachment connection is connected to the carriage of FIG. 3A.

FIG. 14 illustrates a state in which the elevation base 730 is further raised from the state shown in FIG. 13 and the attachment/detachment connection 750 is connected to the carriage 60. When the elevation base 730 is raised after the head cap 740 is connected to the recording head 610, the attachment/detachment connection 750 is connected to the hollow needle 652 of the carriage 60 in a state in which the head cap 740 is connected to the recording head 610, the depressurization provision chamber 751 of the attachment/detachment connection 750 communicates with the depressurization relay chamber 651 of the carriage 60, and the depressurization relay chamber 651 of the carriage 60 communicates with the gas recovery chamber 621 and the gas recovery chamber 641. The pressures of the gas recovery chamber 621 and the gas recovery chamber 641 are decreased to a pressure lower than those of the downstream trap chamber 622 and the upstream trap chamber 642 by receiving the negative pressure from the vacuum pump 710.

According to the printer 10 of the third alternative embodiment, since the depressurization of the ink suction chamber 741 and the depressurization of the gas recovery chamber 641 are simultaneously performed, it is possible to reduce the time necessary for the maintenance of the printer 10.

B. Other Embodiments:

Although several embodiments of the present invention have been described, the principles of the present invention are not limited to these embodiments and may be variously modified without departing from the scope of the invention. For example, the principles of the present invention are not limited to the ink jet recording apparatus and are equally applicable to a coloring material ejecting head used for manufacturing a color filter of an image recording apparatus such as a printer or a liquid crystal display, an electrode material ejecting apparatus used for forming an electrode of an organic electroluminescence (EL) display or a field emission display (FED), a liquid ejecting apparatus for ejecting liquid including a bio-organic material used for manufacturing a biochip, and a sample ejecting apparatus as a precision pipette.

What is claimed is:

1. A liquid ejecting apparatus for ejecting liquid from an ejection head, the liquid being supplied from a liquid supplying source, the liquid ejecting apparatus comprising:

a carriage having the ejection head including:

a liquid channel configured for flowing the liquid from the liquid supplying source to the ejection head, the liquid channel extending through a first carriage member, a second carriage member, a third carriage member, a fourth carriage member, and a fifth carriage member, the liquid channel including an input port for receiving the liquid, the input port being formed in the first carriage member;

a first gas recovery chamber formed in the second carriage member, the second carriage member being below the first carriage member in the liquid flow direction;

an upstream gas trap chamber which is formed in the liquid channel and which is positioned inside the first gas recovery chamber, the upstream gas trap chamber expanding the width of the liquid channel from the first carriage member to the third carriage member, the third carriage member being below the second carriage member in the liquid flow direction, the upstream gas trap chamber expanding in a downstream direction such that the upstream gas trap chamber is wider at a downstream opening than at an upstream opening, the first gas recovery chamber having one or more gas permeable walls defining at least a portion of the upstream gas trap chamber and defining a portion of the second carriage member;

a pressure regulating valve which is provided in the liquid channel of the carriage, the pressure valve being formed in the third carriage member and regulating the pressure of the liquid flowing in the liquid channel, wherein the pressure regulating value is located at a downstream side of the downstream opening of the upstream gas trap chamber and an upstream side of an upstream opening of a downstream gas trap chamber;

a second gas recovery chamber formed in the fourth carriage member, the fourth carriage member being below the third carriage member in the liquid flow direction;

a downstream gas trap chamber which is formed in the liquid channel and which is positioned inside the second gas recovery chamber, the downstream gas trap chamber and expands expanding the width of the liquid channel from the third carriage member to the fifth carriage member, the fifth carriage member being below the fourth carriage member in the liquid flow direction, the downstream gas trap chamber expanding in a downstream direction such that the downstream gas trap chamber is wider at a downstream opening than at an upstream opening, the second gas recovery chamber having one or more gas permeable walls defining at least a portion of the downstream as tra chamber and defining a portion of the fourth carriage;

a communication path defined by the third carriage member and extending from the first gas recovery chamber to the second gas recovery chamber;

a carriage driver which drives the carriage;

an attachment/detachment connection which is detachably connected to the gas recovery chamber according to a position of the carriage; and a depressurization unit which decreases a pressure of the gas recovery chamber to a pressure lower than that of the gas trap chamber via the attachment/detachment connection.

2. The liquid ejecting apparatus according to claim 1, further comprising:

a hermetically sealing valve which is provided in the gas recovery chamber of the carriage and hermetically seals the gas recovery chamber while the attachment/detachment connection is separated from the gas recovery chamber.

3. The liquid ejecting apparatus according to claim 1, further comprising:

a head cleaner which is detachably connected to the ejection head and forms a liquid suction chamber with the ejection head, according to the position of the carriage, wherein the depressurization unit decreases the pressure of the gas recovery chamber to the pressure that is lower than that of the gas trap chamber via the attachment/detachment connection when the attachment/detachment connection is connected to the gas recovery chamber, and decreases the pressure of the liquid suction chamber to a pressure that is lower than that of the liquid channel via the head cleaner when the head cleaner is connected to the ejection head.

4. The liquid ejecting apparatus according to claim 3, wherein the depressurization unit includes a first opening prevention unit configured to prevent negative pressure from being applied by the head cleaner while the attachment/detachment connection is connected to the gas recovery chamber.

5. The liquid ejecting apparatus according to claim 3, wherein the depressurization unit includes a second opening prevention unit configured to prevent negative pressure from being applied by the attachment/detachment connection while the head cleaner is connected to the ejection head.

6. The liquid ejecting apparatus according to claim 3, wherein, when the carriage is in a position in which the head cleaner is connected to the ejection head, the attachment/detachment connection is connected to the gas recovery chamber.

7. The liquid ejecting apparatus according to claim 1, further comprising:

a first determination unit which is configured to determine whether depressurization of the gas recovery chamber is performed by the depressurization unit, according to power applied to the liquid ejecting apparatus.

8. The liquid ejecting apparatus according to claim 7, wherein the first determination unit is a controller that is part of or electrically coupled to the liquid ejecting apparatus.

9. The liquid ejecting apparatus according to claim 1, further comprising:

a pressure sensor provided in the gas recovery chamber of the carriage and configured to detect the pressure of the gas recovery chamber; and a second determination unit which is configured to determine whether depressurization of the gas recovery chamber is performed by the depressurization unit, according to the pressure detected by the pressure sensor.

10. The liquid ejecting apparatus according to claim 9, wherein the second determination unit is a controller that is part of or electrically coupled to the liquid ejecting apparatus.

11. The liquid ejecting apparatus according to claim 1, further comprising:

a third determination unit which is configured to determine whether depressurization of the gas recovery chamber is performed by the depressurization unit, according to an elapsed time from the depressurization of the gas recovery chamber being previously performed by the depressurization unit.

12. The liquid ejecting apparatus according to claim 11, wherein the third determination unit is a controller that is part of or electrically coupled to the liquid ejecting apparatus.

13. The liquid ejecting apparatus according to claim 1, wherein the upstream trap chamber has a truncated conical shape.

14. The liquid ejecting apparatus according to claim 1, wherein the downstream trap chamber has a truncated conical shape.

15. The liquid ejecting apparatus according to claim 1, wherein a filter is placed at the downstream opening of the upstream and downstream trap chambers.

* * * * *